US005508685A

United States Patent [19]

Monte, Jr.

[11] Patent Number: 5,508,685

[45] Date of Patent: Apr. 16, 1996

[54] VEHICLE AND DEVICE ADAPTED TO REVIVE A FATIGUED DRIVER

[76] Inventor: Quentin G. Monte, Jr., 4124 Field Dr., Lafayette Hill, Pa. 19444

[21] Appl. No.: 354,472

[22] Filed: Dec. 12, 1994

[51] Int. Cl.[6] ..... G08B 23/00

[52] U.S. Cl. ..... 340/576; 340/573; 340/575

[58] Field of Search ..... 340/576, 575, 340/573, 407.1; 222/39, 43, 46, 610, 613, 644; 180/271, 272; 368/12

[56] References Cited

U.S. PATENT DOCUMENTS

| | | | |
|---|---|---|---|
| 3,643,836 | 2/1972 | Hunt | 222/648 |
| 4,407,585 | 10/1983 | Hartford et al. | 368/12 |
| 4,509,040 | 4/1985 | Seko et al. | 340/576 |
| 5,012,226 | 4/1991 | Love | 340/576 |
| 5,321,669 | 6/1994 | Thayer et al. | 368/12 |
| 5,347,453 | 9/1994 | Maestre | 364/413 |

OTHER PUBLICATIONS

The Philadelphia Inquirer–Sep. 4, 1994.
Los Angeles Times–Oct. 3, 1994.
The Philadelphia Inquirer–Nov. 27, 1994.

*Primary Examiner*—John K. Peng
*Assistant Examiner*—Benjamin C. Lee
*Attorney, Agent, or Firm*—Paul Lipsitz

[57] ABSTRACT

An alerting device (FIG. 2) for keeping drivers of motorized vehicles alert and an alerting device in combination with a motorized vehicle, the alerting device comprising, in combination, a holder (20) for one or more spray vials (22) filled with a fluid which will stimulate the driver, an electronic alarm (27) activated when fluid in the vial is sprayed and means to attach said device to a section of the cab of the vehicle.

4 Claims, 1 Drawing Sheet

VEHICLE AND DEVICE ADAPTED TO REVIVE A FATIGUED DRIVER

FIELD OF THE INVENTION

This invention relates to a motorized vehicle which incorporates means to revive a person driving the vehicle who becomes tired due to the monotony or length of driving and to an alerting device adapted for use in a vehicle.

1. Background of the Invention

Many vehicle accidents are caused by driver fatigue brought on by monotony of the road or by driving for too long a time without a rest stop. Ideally, a driver of a vehicle on a turnpike or other superhighway should stop at least about every two hours for a rest and a chance to stretch tightened muscles. What most often occurs, however, is that the driver resists stopping and continues to drive without a rest. As a result, driver fatigue sets in and the driver falls asleep at the wheel and an accident occurs. This invention is directed to preventing such accidents and thereby increasing road safety.

2. Brief Description of the Invention

This invention embodies in combination, a motorized vehicle such as an automobile, a truck, or van and the like and means activated by the driver to direct an atomized spray of a non-toxic stimulating fluid into the cab of the vehicle. In another embodiment, the invention provides a unique spray device for the spray means. In still another embodiment, the invention incorporates an electronic chip to alert the driver to activate the spray device.

DISCUSSION OF PRIOR ART

Previous known means to keep drivers alert while driving on the road include such techniques as opening a window, drinking coffee, chewing a crunchy food such as pretzels, and listening to loud music. More recently an electronic device has become available which is worn around the neck and is activated to sound an alarm when the driver's head nods. Applicant is not aware of any device disclosing this invention.

DETAILED DESCRIPTION OF THE INVENTION

As indicated above, the invention comprises, in combination, a motorized vehicle and a device activated by the driver to stimulate a tired driver by directing an atomized spray or mist into the cab portion of the vehicle. The spray device may be any of a wide variety of constructions and may incorporate any type of spray device which sprays a fine mist of fluid, which sprayed fluid may be either a liquid or gas. Such spray devices will include spray dispensers using the known propulsion agents or preferably, those that contain no propellant but are simply squeezed or are pumped by compressing the spray head such as that described in U.S. Pat No. 3,799,448, which patent is hereby incorporated by reference.

The spray device will comprise at least one, but preferably several bottles or vials containing the spray fluid which will be contained in a holder which will allow removal of the vials for replacement or refilling when empty. The device will have a clip or other conventional fastening device to attach the device to the visor, dashboard or other section of the vehicle within reach of the driver. Alternatively, the device may be permanantly installed in the dash, visor or other appropriate part of the vehicle. Preferably, the device will be clipped to the visor and one of the vials, which will contain plain water, and will be positioned so that when sprayed, the fine water mist will be directed toward the face of the driver. The effect of water on the face is refreshing and will overcome the driver's fatigue by the initial shock of the water on the face and also by the cooling effect of the water evaporating. In actual trials, this technique has been successful in keeping a driver alert for from about twenty to about forty minutes. Other vials contained in the device may be charged with non-toxic odorants, fragrances, or other non-toxic stimulating agents which may be sprayed in the interior of the vehicle. When an unpleasant odorant is contained in one of the vials, the offending odor may be removed by air ventilation or by use of a vial in the device which will contain a deodorant which may be sprayed to counteract the foul smell. The vials may also be color-coded or otherwise marked so that the desired vial is readily recognized. Some typically useful odorants will include the aromas of coffee, vanilla, chocolate, fruits, cedar chips and the like. Unpleasant odors may include garlic, onion, skunk, sewage and the like.

Figure 1:
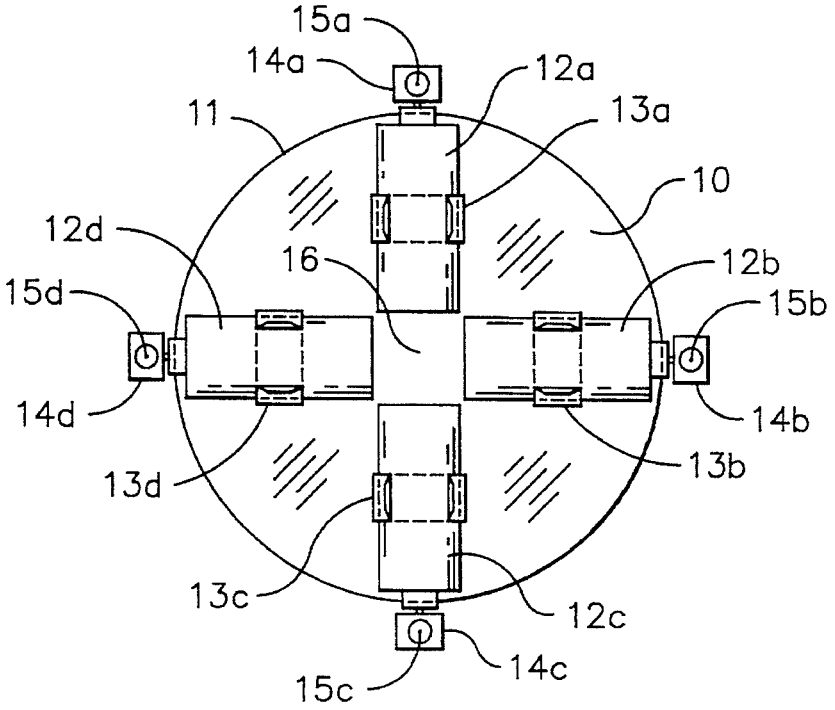
FIG. 1 is a planar view of a preferred embodiment of the spray device which is incorporated in the vehicle.

The preferred type of holder will be essentially a circular configuration with the vials positioned at 90 degrees from each other so that when affixed to the visor or dashboard a vial will be at the top, bottom, and one on each side. Reference to FIG. 1 is now made to better illustrate a preferred device.

In FIG. 1, a planar view of the device is shown in disk form. The disk container will have a top and bottom and will be similar in appearance to a Petri dish. The disk may be made with a transparent plastic top so that the contents of the vials may be seen. The container will hold one or more of the spray vials. In FIG. 1, the spray device is shown generally as 10 and four spray vials 12*a*, 12*b*, 12*c*, and 12*d* are shown held in position in the device by brackets 13*a*, 13*b*, 13*c*, and 13*d* so that the spray heads 14*a*, 14*b*, 14*c*, and 14*d* extend beyond the edge 11 of the device. The spray vial is activated by pushing its head and the fluid is thereby sprayed from the vial at spray nozzles 15*a*, 15*b*, 15*c*, and 15*d*. A clasp or clamp (not shown) for positioning the spray device to the visor or dashboard of the vehicle is at fixed to the bottom of the device. The opening 16 in the center of the device is a useful aid in activating the spray as the thumb of the driver can be inserted in this opening as a forefinger presses the spray head to spray the fluid.

In a preferred embodiment of the invention, the spray device will incorporate an electronic alarm such as a sound or voice chip which will be activated by the driver when the spray is first initiated and will be programmed so that, periodically, after a short period of time (say several minutes) it will alert the driver by emitting an alarm or a vocal command to periodically tell the driver to again spray the fluid into the vehicle. Such chips and their programming for the alerting procedure are well known and are available from Texas Instruments, Phillips Semiconductors, and other chip manufacturers. Examples of such voice chips are those available from Texas Instruments and designated as TSP50C04/06 and TSP50C13/14/19 synthesizers. The voice synthesizer system may also use a Texas Instrument TLC247X family amplifier system between the TTSP50C chip and the audio speaker. Chips containing clock and timing circuits which are useful for the delayed alarm system of the invention are also manufactured by Intel Corporation as single component MCSR-48 system. Such systems are conventionally powered by low voltage miniature batteries such as a 1.5 v. watch battery. The chip is readily programmed for the alerting procedure and will thus assist in keeping the driver alert. Optionally, the electronic chip circuit may also include a continuous or flashing light to indicate operation of the system and add further to driver awareness. A still further optional means to activate the system is a voice command by the driver which, in turn, enables an electromechanical system to cause the alerting fluid to be sprayed into the cab of the vehicle. The electronic and mechanical systems for carrying out such voice commands are known in the art.

Figure 2:
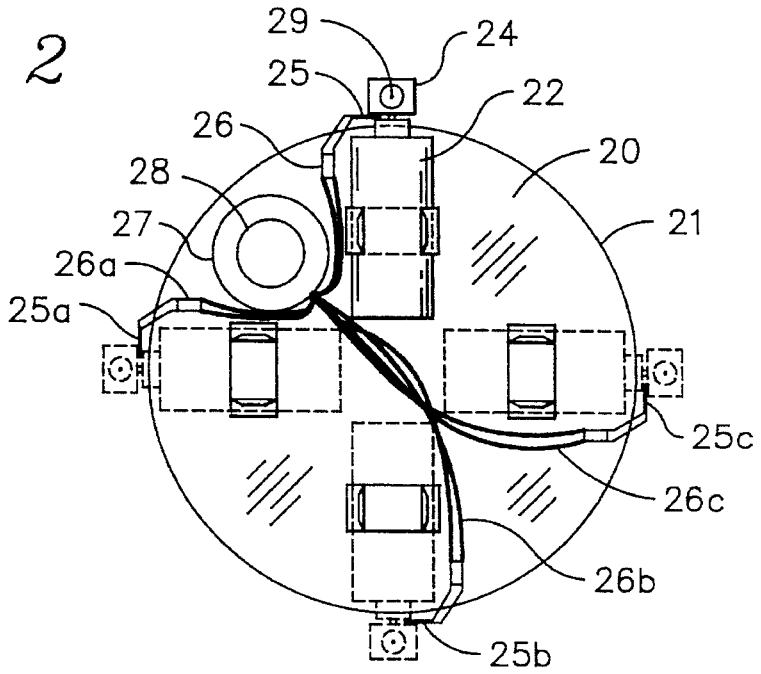
FIG. 2 is a planar view of the spray device which incorporates an electronic alerting chip.

FIG. 2 illustrates the preferred embodiment of the device which includes a sound chip. In FIG. 2, the spray device shown generally as 20 is similar to that shown in FIG. 1 and holds vial 22 with its spray head 24 extending over the edge 21 of the device. Just beneath head 24 is a contact switch 25 with which electrical contact is made when head 24 is pushed down. Wire cable 26 connects the switch with circuitry for an electronic alarm contained in a holder 27 in which is embedded the sound chip, battery, and amplifier, if needed, exemplified by those electrical and electronic devices mentioned above. A speaker 28 connected to the audio output circuit of the alarm is positioned on top of holder 27. Thus, when spray head 24 is pushed down to cause a stream of spray from nozzle 29, the sound chip is activated and due to its programming will emit an alerting sound after a predetermined time. FIG. 2 shows in phantom three additional spray vials which may be optionally incorporated in the device and also shown are wire cables **26*a*, 26*b*, and 26*c* and switches 25*a*, 25*b*, and 25*c*** which would be put to use when the optional vials are used.

What is claimed is:

1. A vehicle and device combination adapted to revive a fatigued driver comprising a motorized vehicle and, in combination with said vehicle, a device to overcome fatigue, said device being affixed to said vehicle within convenient reach of said driver, comprising means activated by said driver to direct an atomized spray of water into the face of said driver of said vehicle, said device incorporating an electronic soundchip alarm to alert said driver to periodically activate said spray.

2. A device adapted to revive a fatigued driver of a vehicle, comprising, in combination: a holder for one or more spray vials each containing a fluid for spraying at the driver for reviving the driver, and reachable by said driver; a sound chip electronic alarm activated to periodically alert said driver when fluid in a said one or more vials is first sprayed by said driver; and means to attach said device to a section of the cab of said vehicle.

3. The device of claim 2 wherein the electronic alarm is a sound chip programmed to emit an alarm after several minutes.

4. The device of claim 3 wherein the sound chip is a voice chip.

* * * * *